United States Patent [19]

McGehee

[11] Patent Number: 4,813,815

[45] Date of Patent: Mar. 21, 1989

[54] BUOYANT, ELASTICALLY TETHERED ARTICULATED MARINE PLATFORM

[75] Inventor: David D. McGehee, Gainesville, Fla.

[73] Assignee: University of Florida, Gainesville, Fla.

[21] Appl. No.: 110,732

[22] Filed: Nov. 17, 1987

Related U.S. Application Data

[62] Division of Ser. No. 761,498, Aug. 1, 1985, abandoned.

[51] Int. Cl.[4] ..... E02B 17/00

[52] U.S. Cl. ..... 405/202; 405/224

[58] Field of Search ..... 405/202, 224, 195, 200; 114/230; 441/1, 3

[56] References Cited

U.S. PATENT DOCUMENTS

| | | | |
|---|---|---|---|
| 856,713 | 6/1907 | Lovley | 405/202 X |
| 2,079,689 | 5/1937 | Gorton . | |
| 2,986,888 | 6/1961 | Borrmann et al. . | |
| 3,101,491 | 8/1963 | Salo . | |
| 3,500,783 | 3/1970 | Johnson, Jr. et al. . | |
| 3,524,323 | 8/1970 | Miller . | |
| 3,559,223 | 2/1971 | Lockwood, Jr. et al. . | |
| 3,708,985 | 1/1973 | Pogonowski et al. . | |
| 3,756,293 | 9/1973 | Adler et al. | 405/202 X |
| 3,903,705 | 9/1975 | Beck et al. . | |
| 4,110,628 | 8/1978 | Paull et al. . | |
| 4,126,010 | 11/1978 | Michel et al. | 405/202 |
| 4,155,673 | 5/1979 | Yashima | 405/224 |
| 4,170,186 | 10/1979 | Shaw . | |
| 4,432,668 | 2/1984 | Rank | 405/202 |

*Primary Examiner*—David H. Corbin

*Attorney, Agent, or Firm*—Dennis P. Clarke

[57] ABSTRACT

Structures for providing a stable platform in or above the water and capable of surviving extreme environmental conditions and of minimizing risk and damage to itself and to vessels in the event of a collision. A disclosed structure includes a base mooring element fixed to the seafloor, a positively buoyant column having a base end and an opposite end, at least one articulated joint between the column base end and the base mooring element permitting pivotal movement of the column, and at least one elastic element connected to the column for urging the column towards an equilibrium position and for providing a restoring force following displacements of the column from the equilibrium position. Significantly, buoyancy primarily serves the function of returning the column to a vertical or near-vertical position to facilitate location and repair in the event an elastic element is broken. Also significantly, the elastic element serves to control static and dynamic response to external forces, but is not vital to structural integrity.

15 Claims, 7 Drawing Sheets

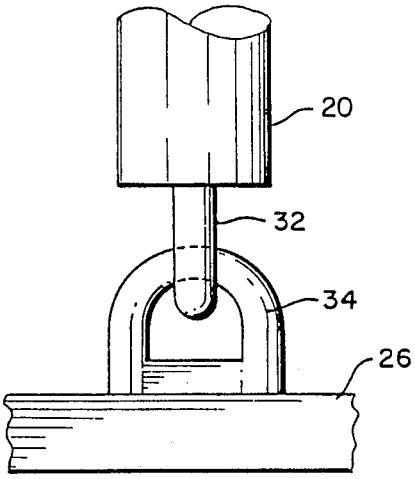
FIG 3
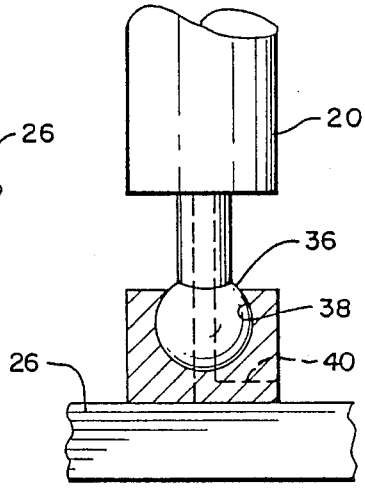
FIG 4
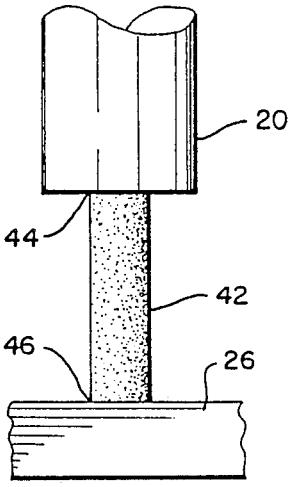
FIG 5
FIG 7
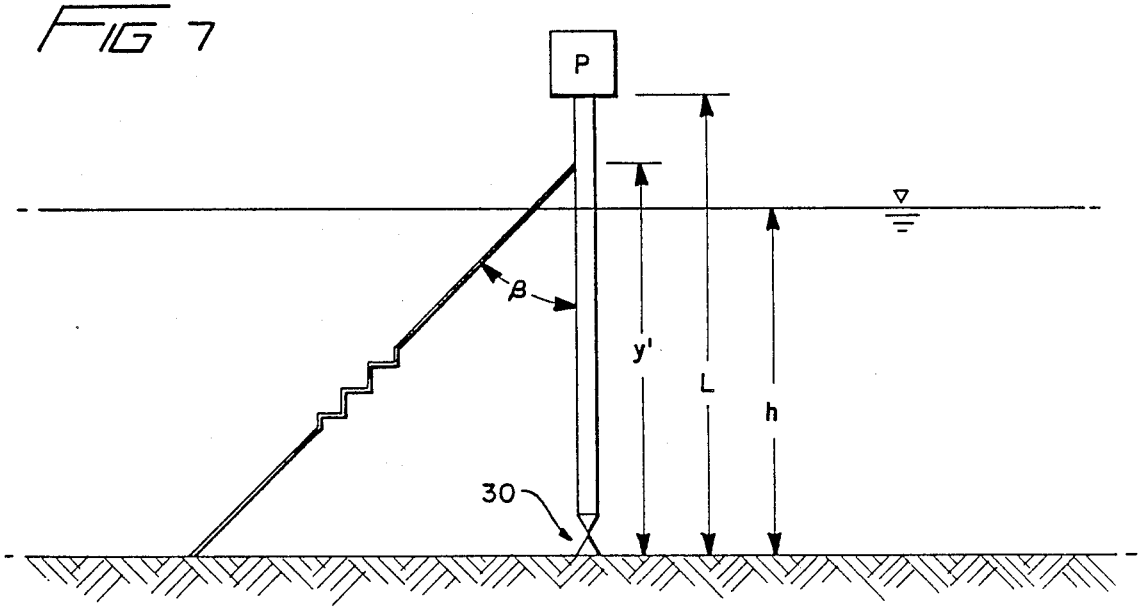

22
100
102
103
104
105
106
108
110
112
114
116
118
120
B
Δx
L
WATER DEPTH
24
R 22
22
B
130
130
130
130
134
134
132
136
136
138
104
104
106
106
L
WATER DEPTH
R
Δx 22
22
L
WATER DEPTH
24
B
ΔX
100
114
103
108
104
105
106
110
R
140
142
144

22
22
B
100
100
152
152
104
104
106
106
103
L
WATER DEPTH
24

BUOYANT, ELASTICALLY TETHERED ARTICULATED MARINE PLATFORM

This is a divisional of application Ser. No. 761,498 filed Aug. 1, 1985, now abandoned.

BACKGROUND OF THE INVENTION

The present invention relates generally to structures for providing a stable platform at sea for such purposes as instrumentation support, navigation aids, mooring for ships, drilling platforms, energy extraction and aquaculture. More particularly, the invention relates to such a structure which is capable of surviving extreme environmental conditions, and which minimizes the risk of damage to itself and to vessels in the event of a collision. Structures embodying the invention are suitable for use in relatively shallow off-shore waters (e.g. thirty feet) where wave height can be a significant fraction of the total water depth, as well as in deep water applications.

As is well known in the art, there are significant problems involved in providing stable, fixed platforms at sea which can survive extreme sea conditions, such as hurricanes, thereby avoiding the cost and inconvenience attendant to the loss of what are relatively expensive installations. Ocean structures in shallow water in particular face different, and often more severe, conditions than either land or deepwater structures, yet they have almost exclusively been based on traditional designs evolved in those two regions. Environmental conditions may remain mild for extended periods, particularly in tropic and subtropic waters, until a major storm or hurricane occurs, subjecting the structure to intense breaking wave impact forces, high currents, and resulting foundation scour. As a further example of the differences, and based on personal experience of the inventor in designing and installing coastal structures, a much more likely danger is an encounter with a vessel. This more likely danger is a result of the increased number of vessels near shore and the concentration resulting from channel-bound traffic.

Traditionally, two general classes of structures have been employed to provide fixed platforms at sea. Structures of the first class are moored floating buoys. Structures of the second class are rigid, and range from a single piling driven into the sea floor, to tower-like steel structures used in offshore drilling and production. These two classes of structure are discussed in detail next below.

Moored floating buoys and other floating structures, which perform satisfactorily in deep water, show deficiencies as depth decreases. To briefly enumerate three:

(1) Imprecise positioning due to allowable watch circle;

(2) Violent wave induced motion in storms; and (3) High incidence of mooring failure or dragging from cyclic impact loading in storms.

Thus, moored floating buoys, by their very nature, are relatively less stable than fixed platforms, and this factor alone can make them unsuitable for many applications. Navigational markers, in particular, require precise positioning, and high reliability, in spite of high collision incidence probability. A surface-following buoy is particularly poor in this regard.

Certain forms of buoys, however, provide much better stability. For example, spar buoys are relatively unaffected by wave motion (except in the resonant mode). On the other hand they are much more susceptible to current and wind induced tilting, particularly with any appreciable payload.

Moreover, one analysis of a tethered spar buoy Chabra, Narender K., "Dynamics of a Tethered Spar Buoy System-Validation Using Full Scale Ocean Tests Data," ASCE Proc. *Civil Engineering In The-Oceans/4*, Vol. 1, 1979, p. 208, refers to a parameter called the heave response amplitude operator, which can vary from less than 0.1 to 4.0 or even higher at values of nd between 0.2 and 0.5, where n is the wave number and d is the draft of the buoy. This analysis would indicate that a spar buoy drawing ten feet could impact the bottom in six foot waves having a period of from five to eight seconds, a likely wave condition in thirty foot deep water.

In any case, the survival rate of all types of buoys in extreme sea conditions has not been good. Small navigation buoys using anchors of over twice their displacement often break or drag their moorings in storms. Any buoyant object moored by a flexible, slack chain or cable imposes severe strains on the mooring due to the momentum of the object. In a breaking wave condition, a buoy will surf down the face of the wave with considerable velocity, until the mooring abruptly stops it short.

Another form of buoy which has been advocated is a taut moored buoy. This approach has proven successful to others in deep water, Schick, George B., "Design of a Deep Moored Oceanographic Station", Transactions, 1964, Buoy Technology Symposium", MTS, p. 119; Black, David L., "A Stabilized Buoy for Oceanographic & Meteorological Instrumentation", Transactions, 1964, Buoy Technology Symposium, MTS, p. 603; and Fofonoff, N. P., "Current Measurements from Moored Buoys", Transactions, 2nd International Buoy Technology Symposium, MTS, 1967, p. 409. Comparative tests have shown that taut moorings are best suited for survival in the open sea. An example of a taut mooring employing a submerged buoyant member is disclosed in Paull et al U.S. Pat. No. 4,110,628.

Thus, the taut moored buoy approach is not readily applicable to shallow water buoys. Many taut moored systems, in order to remove the body providing the "tautness" from the effect of waves, are completely subsurface or rely on a subsurface float as the mooring point. Others employ surface floats of various streamlined shapes (e.g. spar, plank on edge, disk, boat shaped or catamaran) to reduce buoy motion and the loading on the moorings. In deep water, where even the highest wave is small relative to the depth, the mooring line is unlikely to go slack as the buoy enters a trough, nor is the buoy likely to submerge under a crest. One cannot make the same assumption when designing for wave heights of two thirds the water depth as is the case in relatively shallower waters.

The second general class of structure mentioned above is a rigid structure. The rigid structure solves some of the problems of floating buoys, while creating others of its own. A simple example of a rigid structure is a single vertical piling driven into the sea floor, and such structures are employed as navigation markers in relatively protected waters. Rigid pile structures are best suited to supporting gravitational loads through compression, and are less suited to carrying side loads through shear. In a collision situation they can fail catastrophically, or result in damage to relatively smaller vessels, or both.

As a more rigorous example of the limitations of this relatively simple rigid structure, static analysis of a ten-inch diameter pre-stressed piling loaded by a ten foot wave in thirty feet of water, using methods outlined in the "Shore Protection Manual", Vol. II, pp. 7-81, U.S. Army Coastal Engineering Research Center, 1973, predicts failure of the piling at the mudline.

Dolphins are sometimes employed as mooring and fendering devices around harbors, and for supporting navigational aids in any waters. A dolphin is a cluster of essentially vertical, slightly inwardly angled, pilings, typically of wood driven into the bottom and penetrating above the surface. Generally, the pilings are banded together at their top ends. A group of pilings arranged in a dolphin could be designed to withstand a ten foot working wave and perhaps even a twenty-one foot design wave. Topped with a platform, such a structure looks much like a section of a pier cut off and transplanted to deeper water. Survival of ocean front piers in extreme sea conditions has not traditionally been good.

Further raising questions of the structural integrity of rigid structures, the Texas Coastal and Marine Counsel at Austin, Tex. constructed a 45-foot tripod type steel tower mounted to the deck of a scuttled liberty ship to mark the site as an artificial reef. This tower was constructed in response to repeated losses of large (565 cubic foot) free floating buoys. After service of little over a year, this tower was "laid over on the deck by unidentified forces.", Lee, Howard T., "Buoying & Marking of Artificial Reefs—A State Experience," Proceedings *Artificial Reefs*, Florida Sea Grant Report #41, February 1981. This experience is a typical example of the cost and frustration encountered in erecting shallow water platforms.

Even aside from the question of structural integrity, the logistics of erecting a pile-supported structure require a pile driver, with accompanying derrick barge and tug, all of which are costly.

An approach intermediate a moored floating buoy, on the one hand, and a rigid structure on the other hand, is an articulated column. An articulated column can be conceptualized as a rigid buoyant piling fitted with a zero moment pivot pin at its base, or as a spar buoy extended downward until only one link of its mooring chain is left. One example of such an articulated column is disclosed in an article by John L. Kennedy, "Buoyant Tower Would Allow Deepwater Platform Drilling"; *The Oil and Gas Journal*, Oct. 28, 1974, pages 61-67. Another examples is disclosed in Pogonowski et al U.S. Pat. No. 3,708,985.

An advantage of this configuration, due to its compliant nature afforded by the pivoting base, is its ability to withstand extreme wave forces, without experiencing the high velocities and momentum forces of the surface following buoy.

However, where the purpose is to provide a relatively stable platform which maintains its orientation under normal working wave conditions, such an articulated column falls short, as will be appreciated in view of the following analysis read in conjunction with the plots of accompanying FIG. 1.

FIG. 1 individually plots several relevant forces as a function of column diameter for an articulated column in water thirty feet deep. In FIG. 1, plot line B is total buoyant force of a hollow column, with buoyancy provided by air inside, neglecting the weight of the column. Plot line $F_B$ is the tangential component of the total buoyant force B at an angle of displacement $\theta=15°$. Four wave force functions, $F_M$, are plotted for respective wave heights H of H=3, H=6 and H=8 feet. As indicated, the wave force $F_M$ is a function of $\phi_M$, a parameter used to calculate wave forces on cylindrical bodies, W, the specific weight of seawater, which is 64 lb/ft$^3$; $C_D$, a drag coefficient; as well as wave height H and pile diameter D. The wave force function $F_m$ is taken from the "Shore Protection Manual" referenced above. Conservative estimates for the various parameters are employed in FIG. 1

Based on the plots of FIG. 1, it can be predicted that the restoring buoyancy of the column is less than the ten foot wave force up to column diameters D of 8.2 feet, assuming that a 15° displacement from vertical is tolerable. In other words, for diameters less than 8.2 feet, the displacement would exceed 15° under the force of ten foot waves. An 8.2 foot diameter is unrealistic because, even in thirty feet of water, the static mooring forces alone would exceed 100,000 pounds.

Thus, relying upon buoyancy for vertical stiffness is counterproductive. Moreover, since the restoring force is proportional to the sine of the deflection angle from vertical, the buoyant restoring force does not start holding the structure up until it is well on its way down.

Accordingly, the traditional approach to supporting vertical towers is to employ guy wires. This, however, turns the articulated column back into a rigid structure which relies on its weakest link (the guy wires) for support. As the guy wires attempt to maintain the tower vertical, extreme forces are developed as a result of the non-compliant nature of a rigid structure, and long-term survivability is unlikely.

A partial answer is provided by clump weight systems which include what would otherwise be relatively slack guy wires made taut by clump weights attached near the ends of the guy wires and designed to rest on the sea floor. The guy wire dimensions are adjusted such that the tower is held vertical when the clump weights are resting on the sea floor. Such a system is disclosed in Beck et al U.S. Pat. No. 3,903,705.

The compliancy thus provided increases the survivability of the tower. When sufficient force is applied, the clump weights are lifted off the bottom. Thus, while the tower is allowed to tilt, catastrophic failure may be averted. In an analysis of geo technical aspects of a compliant tower, Audibert et al states, "the flexible response characteristics of the tower and guying system significantly reduces stresses in structural members as it allows the tower to essentially move as a rigid body (Audibert, Jean; Dover, Anthony R., Thompson, Grant P., and Hubbard, Jack L., ASCE Proc. Civil Engineering in the Oceans/4, Vol. 1, 1979, p. 820.) By adjusting the weights, and thus the force, the response parameters such as compliance of the tower can be "tuned" or adjusted over a wide range of selected displacements.

The Audibert et al model referred to above is for a platform in relatively deep water where the allowable excursions are small, such as drilling platforms beyond the continental shelf. Such use of clump weights, however, does not appear to be a viable alternative for use in intermediate depth water, for two reasons:

(1) "Tuning" or adjusting the tower for high compliance allows corresponding large excursions of the clump weights. Limiting the compliance or stiffening the structure requires heavier weights. In either case, the inertial loading of the accelerating weights (which are themselves subject to complex wave forces totally out of phase with the tower loading) on the guy wires can be severe, particularly if opposing wires alternately go slack once each wave period.

(2) In an area of littoral suspension and resettlement, clump weights tend to become buried and thus convert to non-compliant moorings. This problem was addressed without solution by Audibert et al and is also addressed by the disclosure of Beck et al U.S. Pat. No. 3,903,705.

One of the above two reasons could be responsible for the failure of the Atlantic Oceanographic Laboratory Stable Platform, a guyed tower using clump weights installed in 187 feet of water near Halifax Harbor entrance.

According to an unpublished report, that particular structure performed well for several months in seas up to eight meters, but was damaged in ten to twelve meter waves when two guy wires parted. The failure was attributed to underestimation of the wave climate, underestimation of wave forces on the structure, occurrence of the structure's pitch resonance within the range of predominant wave energy, and inability to properly position and tension the clump anchor.

The Atlantic Oceanographic Laboratory Stable Platform was not constrained at its base. Rather, it relied on its net 5.9 tons of negative buoyancy and penetration into the sediment to eliminate heave. The assumption that heave would be so eliminated appears to be invalidated by evidence in the report, including lateral displacement of the tower, failure of the base section, as well as measurements from a vertical accelerometer mounted on the platform.

Variations on the clump weight approach have been proposed. For example, Miller U.S. Pat. No. 3,524,323 proposes a system of guy wires terminated at their lower ends by weights confined in vertical tubes to permit the weights to be vertically lifted off of the tube bottoms as the tower tilts.

In a more substantial variation, Borrmann et al U.S. Pat. No. 2,986,888 proposes a guy wire system with submerged floats, rather than weights, affixed to intermediate points on the guy wires. In order to maintain the floats in relatively fixed positions when the tower is in its undeflected vertical position, each float actually has a pair of anchor lines spaced apart at their lower ends to define a triangle with the float at the apex of the triangle. This anchor line configuration limits the upward movement of the Borrmann et al floats in a manner analogous to the manner in which the seafloor limits downward movement in a clump weight system.

Another disadvantage, common to both clump weight systems and guy wire float systems, is that there is an upper limit to the deflection before each weight or float is in line with its respective guy wire and the system reverts to a rigid guy wire system. Thus, past a certain tower tilt angle, the system loses its compliancy. It is precisely when compliancy is most needed for survivability, i.e. under extreme environmental forces, that compliancy is lost.

Yet another disadvantage is the large amount of area required for the guy wires and buoys or weights.

SUMMARY OF THE INVENTION

Accordingly, it is an object of the invention to provide a marine platform structure having the required degree of stability for useful application, which can survive extreme environmental conditions, and which minimizes the risk of damage to itself and vessels in the event of a collision.

It is another object of the invention to provide such structures which may readily "tuned" through adjustment of various design parameters to achieve adjustability to suit any one of a large number of applications.

Briefly, and in accordance with an overall concept of the invention, three principal aspects, buoyancy, elasticity and compliant articulation are effectively combined to achieve the desired results. During the process of design, each of these three aspects can be varied, and a number of geometrical configurations can be employed without departing from the concepts of the inventions. To provide a convenient name, a Buoyant, Elastically Tethered Articulated marine platform in accordance with the invention may be termed a BETA platform.

Somewhat generally, the present invention can be characterized as a self-righting, compliant vertical column connected by an articulating joint to the seafloor, using elastic elements such as tethers for controlled dynamic response, and supporting a payload in or above the water.

Employed as a support for a navigational marker, for example, the present invention provides a marker which maintains its prescribed location precisely, remains essentially vertical in all but the most severe environmental conditions, and withstands repeated 90° knockdowns from collisions and immediately returns to vertical without experiencing structural failure of any component.

More particularly, the present invention provides a marine structure for supporting a load, and which is positioned in a body of water having a floor. The marine structure includes a base mooring element fixed to the floor, a positively buoyant column having a base end and an opposite end, at least one articulated joint between the column base end and the base mooring element permitting pivotal movement of the column, and at least one elastic element connected to the column for urging the column towards an equilibrium position and for providing a restoring force following displacements of the column from the equilibrium position.

Particular embodiments of the invention may take various geometrical forms. There are two overall types in particular, which can be designated outward-extending and compact. The outward-extending form makes optimum use of the elastic tethers, but is best employed in remote locations where vessel traffic is not a significant hazard. The compact form in several embodiments has elastic tethers placed parallel to the vertical axis of the structure, either inside or just outside the column, and has optimum survivability in the event of collision with a vessel. In one compact embodiment, the elastic element is a torodial compressive elastic member.

A typical embodiment of the outward-extending elastic type can be visualized by starting with a pivotally-mounted tower held upright by guy wires. In a structure embodying the invention, the pivoting (articulating) base mount is retained and, the tower is made buoyant if it is not already. Finally, the guy wires are replaced by elastic elements, which may be referred to as elastic tethers. While superficially similar to several of the prior art structures as summarized above, in fact the structure is of an entirely new type.

Significantly, while buoyancy of the column is an essential element, the function and necessary degree of this buoyancy are quite different compared to prior art approaches. Specifically, the buoyancy primarily serves a single function: If an elastic tether is broken, the tower will return to a vertical or near-vertical position to facilitate location and repair of the tower. With minimal buoyancy sufficient only to serve this particular purpose, wave forces on the structure are minimized. It should, however, be noted that, under some circumstances, for particular design purposes, buoyancy greater than that which is necessary merely to return the tower to a vertical position may be employed.

The elastic tethers are significantly different in purpose and result compared to either rigid guy wires, guy wires with clump weights, or guy wires with submerged floats. Significantly, the elastic tethers are not vital to the structural integrity of the structure. Rather, their sole purpose is control of the static and dynamic response to external forces.

Additionally, each elastic element can exert its restoring force only along the axis of the tether. This is unlike the buoyant or gravity force of floats or clump weights which acts at an angle to the respective guy wire axis. Any component of force not in line with the guy wire does not contribute to restoring the column to its equilibrium position, while at the same time stresses the system unnecessarily.

The elastic tethers can take a variety of forms. Examples are a continuous length of elastomeric, an elastomeric section in combination with at least one relatively inelastic section, a coil spring, and a coil spring in combination with a relatively inelastic section, such as wire, chain or rope. As another alternative, pneumatic springs may be employed, which use the compression or expansion of a gas as a restoring force, either with or without wire, chain or rope in combination. In any event, the elastic elements present negligible additional drag forces on the structure, and add negligible inertial loading. Related to the negligible additional drag forces and negligible inertial loading, it is highly unlikely the elastic tethers will ever go slack, thus avoiding abrupt forces such as occur when slack is taken up. Moreover, unlike clump weights, the elastic elements are not in danger of becoming buried.

Through appropriate design procedures, the tower can be easily "tuned" by the selection of an appropriate spring constant k. At one extreme, with a sufficiently stiff spring, having a constant $k_{max}$, the column remains essentially vertical for any desired working sea condition. At the other extreme, with a sufficiently stretchy spring, having a constant $k_{min}$, the column can deflect under any design wave, having a design wave height $H_D$, until equilibrium is reached between the diminishing wave force and the increasing restoring spring force, without exceeding the elastic limit of the spring.

It is significant that it is the configuration and compliance of the components, and not their strength, which allows the structure to withstand a breaking wave of design height $H_D$, even if the wave is of sufficient energy to force a complete "knock down", i.e. a deflection of 90°, and return to vertical with the next wave trough. Thus, the structure in accordance with the invention can be designed to withstand any conceivable environmental condition. When the structure is completely laid over at 90°, and thus is on the bottom, environmental forces can no longer act on it.

In this first general type wherein embodiments of the invention employ outward extending elastic tethers, it will be appreciated that the articulated joint includes elements for fixing the column base to the base mooring element in a manner which permits pivotal movement while restraining translational movement. This may be accomplished in various ways. For example, the articulated joint may comprise a plurality of chain links, as few as two. Alternatively, the articulated joint may comprise a ball and socket joint. As another alternative, the articulated joint may comprise a section of elastomeric material. As yet another alternative, the articulated joint can comprise a universal joint.

The second general type for embodiments of the invention identified above is the compact type, which has the advantage of completely eliminating the possibility of a vessel encountering elastic tethers. As one specific example, the elastic elements, rather than diverging angularly outwardly as described above, extend generally parallel to the column between upper attachment points and lower attachment points fixed to the base mooring element adjacent the articulated joint.

As another example of the compact type, the buoyant column comprises a tubular element having an interior space and having a defined central axis extending within the interior space. A typical diameter of the buoyant column would be one foot, or slightly larger.

In such embodiments, the base mooring element includes a surface for supporting the base end of the buoyant column and a base attachment point substantially in alignment with the central axis of the column when the column is in its equilibrium position. The articulated joint includes an element projecting upwardly from the base mooring element suitably configured to engage the base end of the buoyant column.

The elastic element extends within the column interior space between a portion of the column spaced from the base end and the base attachment point.

Thus, at the column equilibrium position, the elastic element is at its minimum length and the base of the column rests squarely on the surface of the base mooring element. Pivotal movement of the column raises portions of the column base off of the supporting surface, except for a contact area facing the direction of the tilt. Thus, the elastic element is extended, and the restoring force which it accordingly generates provides a force urging the column back towards the equilibrium position.

As yet another example of the compact type, a compressive elastic member of torodial configuration may be employed at the column base. In such embodiments, an annular gap is defined between the column base end and the base mooring element, and the torodial compressive elastic member is disposed in the annular gap.

BRIEF DESCRIPTION OF THE DRAWINGS

While the novel features are set forth with particularity in the appended claims, the invention, both as to organization and content, will be better understood and appreciated from the following detailed description taken in conjunction with the drawings, in which:

FIG. 3 depicts an articulated joint comprising a pair of chain links;

FIG. 4 depicts an articulated joint comprising a ball and a socket;

FIG. 5 depicts an articulated joint comprising a section of elastomeric material;

FIG. 7 is a schematic representation, for purposes of analysis, of the components of an elastically tethered buoyant column at rest in still water;

DESCRIPTION OF THE PREFERRED EMBODIMENTS

The specific embodiments described herein are for an instrumentation platform located in relatively shallow (e.g. thirty feet deep) water approximately fifteen miles offshore where relatively severe environmental forces are ultimately expected to be encountered. In this particular application, in order to maintain operation of a directional antenna employed for transmitting data, it is a design requirement that the force of waves ten feet high shall not cause deflection more than 10° from vertical. In addition, the natural resonant frequency of this structure shall not be such that wave energy can excite harmful oscillations. Normal wave energy has a period of from four to eight seconds. Thus, the natural resonant frequency could be either higher or lower to avoid excitation. In the first particular embodiment described hereinbelow, the resonant frequency was selected to be higher, the specific frequency corresponding to a period of approximately one second. Waves that fast are quite small, and do not have enough energy to excite harm-inducing oscillations.

Figure 1:
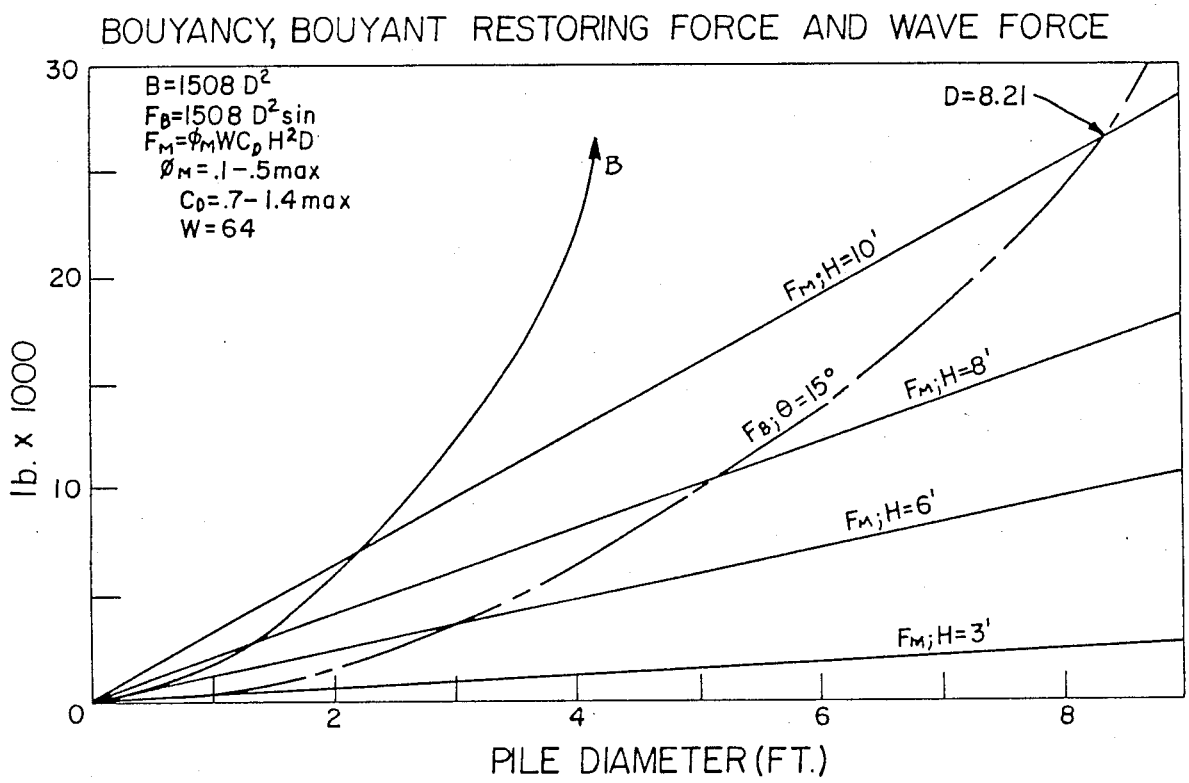
FIG. 1, referred to hereinabove, is a graph depicting plots of buoyancy, buoyant restoring force and wave force as a function of pile diameter.
Figure 2:
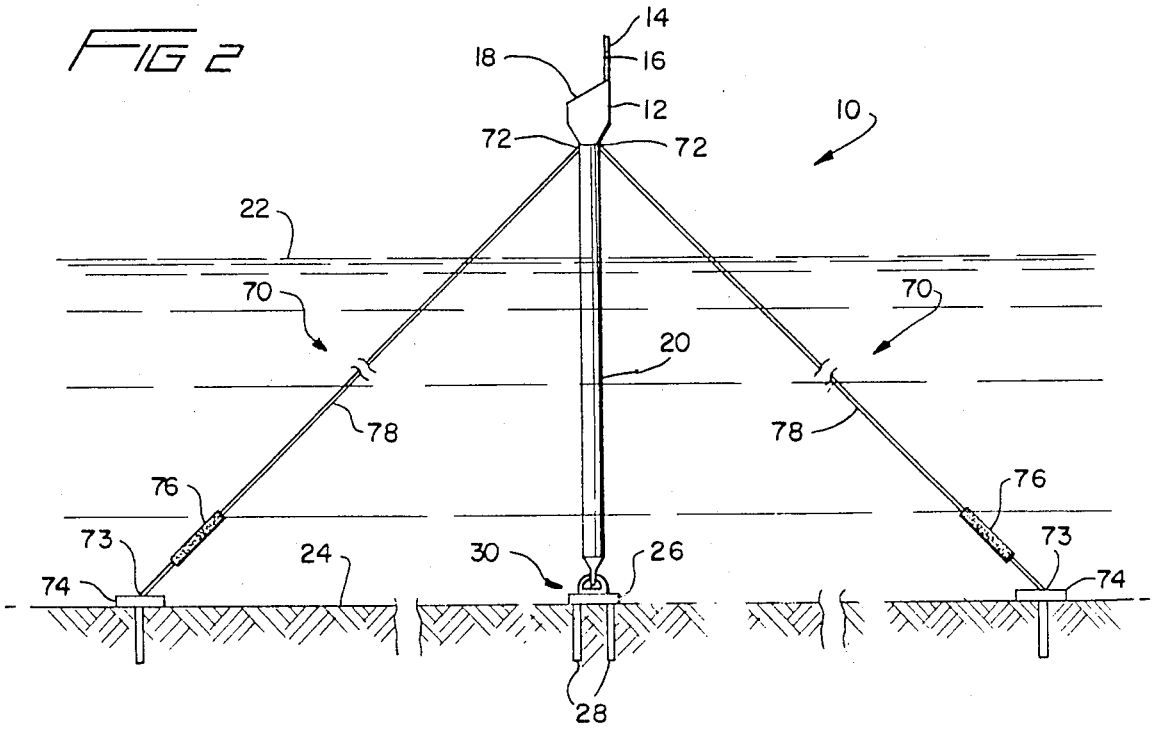
FIG. 2 is a schematic depiction of an embodiment of the invention employing external elastic tethers.

An exemplary structure 10 in accordance with the invention is depicted in FIG. 2. The structure 10 supports an instrumentation package 12 including a telemetry transceiver, an antenna 14, a navigation light 16 and solar panels 18 which supply power. The weight of the instrumentation package 12, including the solar panels 18, the navigation light 16 and a battery pack (not shown) is approximately 190 pounds. The instrumentation package 12 is supported on a positively buoyant column 20 which is forty feet in length and twelve inches in diameter. The water depth is such that the surface 22 is thirty feet above the seafloor 24 under calm sea conditions.

More particularly, the buoyant column 20 comprises twelve inch diameter schedule 40, aluminum pipe, grade 6061-T6. To fabricate the column 20, two twenty-foot lengths of pipe were butt welded together, then a sleeve of ¼ inch plate, twelve inches wide, rolled to the proper diameter, was welded over the joint for reinforcement. To provide the necessary buoyancy, the entire column is filled with suitably shaped "logs" of styrofoam, and the ends welded shut. The styrofoam thus provides positive flotation even in the event of flooding of the column, either through a faulty weld or, more likely, attack by gunshot.

A variety of alternate methods for achieving buoyancy of the column 20 may be employed. One example is an air-filled, hollow pipe (with either circular or non-circular sections). This configuration allows for the placement of equipment or instruments within the column, or the passage of personnel through the column. Another approach is to make the column of buoyant material, such as wood or plastic. Yet another approach is to employ negatively buoyant material, such as a steel beam, with external buoyant bodies attached, either continuously or at discrete intervals along its length. These various approaches as well as others, can be combined in one structure.

The column 20 stands above a base mooring element 26, which in turn comprises a ¾ inch thick steel plate four feet by six feet secured by pilings 28. For convenience, 900 pound railroad wheels were employed in the base mooring element, including a central wheel resting on the steel plate, and four additional wheels stacked in a overlapping configuration around the perimeter of the central wheel, and supported at their opposite sides by risers welded to the plate. A two-inch schedule 80 pipe piling 28 is driven through the center of each wheel and the plate beneath it, with the entire base mooring structure 26 clamped together in sandwich-like fashion.

Between the lower end of the column 20 and the base mooring element 26 is an articulated joint 30 which allows rotational (i.e. pivotal) freedom while constraining translational freedom. The joint 30 is located beneath the wave-affected zone, either on the seafloor 24, or raised on a pedestal (not shown) of appropriate height above the seafloor 24. The joint 30 may be compounded by having one joint at the seafloor 24, or slightly above, and additional joints along the length of the column 20, or between multiple column sections (not shown). Such relocation or duplication of the articulated joint at several locations along the length of the column 20 would particularly facilitate applications in deeper water. The precise construction of the articulated joint 30 is selected to match prevailing conditions and requirements. Various forms are possible, and four examples are depicted in FIGS. 3, 4, 5 and 6, respectively.

FIG. 3 depicts an articulated joint comprising a pair of ordinary chain links 32 and 34 secured to the base of the column 20 and the base mooring element 26.

FIG. 4 depicts a ball and socket joint comprising a ball element 36 and a suitable socket 38. This is a relatively more expensive type of joint, but might be employed where it is necessary to transport a fluid through a joint, as represented by the passage 40, such as in the case of a riser for a production platform.

FIG. 5 depicts another form of articulated joint comprising a section of elastomeric material 42 in the form of a rubber tube suitably secured at endpoints 44 and 46.

Figure 6:
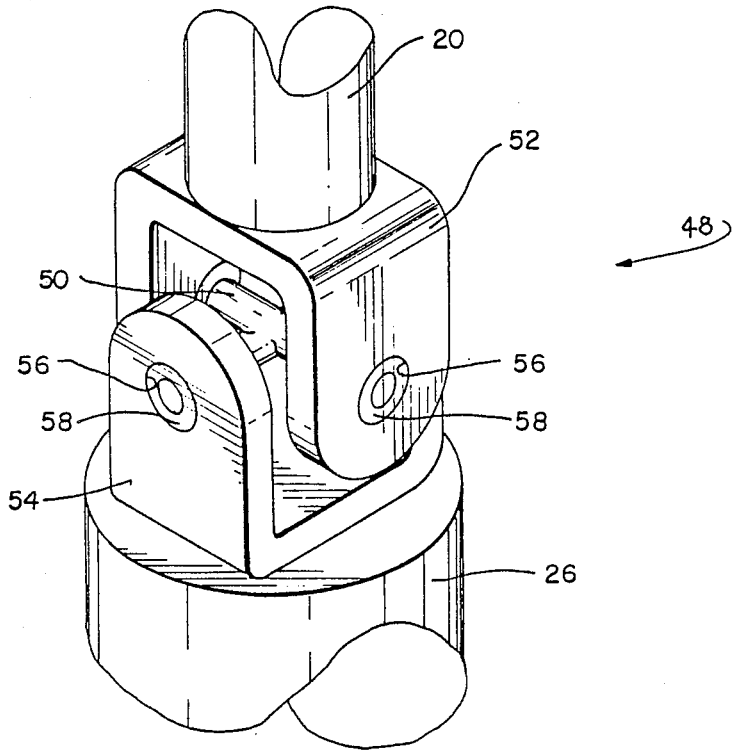
FIG. 6 depicts an articulated joint comprising a universal joint.

Finally, FIG. 6 depicts an articulated joint comprising a universal joint 48. The universal joint 48 includes a central spider element 50 and a pair of yokes 52 and 54 secured to the column 20 and base mooring element 26, respectively. The yokes 52 and 54 are bored as at 56 to receive bearings 58 which allow relative rotational movement between the arms of the spider element 50 and the corresponding yokes 52 and 54.

Referring again to FIG. 2, a final overall element of the structure are elastic elements, generally designated 70, connected to the column 20 for urging the column 20 towards the vertical equilibrium position illustrated, and for providing a restoring force following displacements of the column 20 from the equilibrium position.

For the elements 70, three elastic tethers are employed extending between respective upper attachment points 70 connected to a portion of the column 20 spaced from the base end, and respective lower attachment points 73 fixed to the seafloor 24 via respective tether mooring elements 74. In the illustrated embodiment, the upper attachment points 72 are proximal the upper end of column 20. The tether mooring elements 74 are similar to the base mooring element 26. In an exemplary embodiment, the mooring elements 74 each comprise a pair of 900 pound railroad wheels clamped to a two inch diameter schedule 80 pipe piling driven into limestone bedrock to a depth of six feet.

In the illustrated embodiment, the lower tether attachment points 73 and the tether mooring elements 74 are each located one hundred feet from the base mooring element 26. The elastic tethers 70 are thus each approximately one hundred eight feet in length, and diverge angularly with respect to the column 20 from the upper attachment points 72. The elastic tethers are stretched to a maximum one hundred forty feet when the tower is laid completely over.

The elastic tethers 70 themselves preferably are designed to withstand maximum elongation, i.e., a condition wherein the tower has pivoted 90° from vertical, and remain in their elastic range.

In FIG. 2, the elastic tethers 70 each comprise a section of elastomer 76 connected to a relatively longer section 78 of steel cable. For the elastomer 76, rubber cord is suitable. The rubber cord selected was supplied in sections fifteen feet long, and three inches in diameter. The particular material is known as EPDM, with a Durometer hardness of 70.

Actual tests on a fifteen foot length of cord determined that the spring constant k is 200 lb/ft, with a maximum elongation of 220%. This is sufficient to accommodate the tower laid over at a 90° angle from vertical.

A difficult question in the use of this material is the end terminations. While the elastic cord itself has sufficient strength, it is somewhat difficult to securely fasten to a three inch diameter cord and keep a grip on it of several thousand pounds while it is continually shrinking in diameter. Any method of clamping or gripping the outside of the cord must contend with a decreasing section to grip. Moreover, any termination which penetrates the end section of the cord with pins or bolts results in a decrease in area in that section, creating a weak point.

Three types of terminations were evaluated. The first type employs a section of 2½ inch I.D. steel pipe (not shown) with four to six through bolts piercing the rubber. The clamping effect of the pipe takes up the strain for the majority of the smaller stresses, while the bolts take up the larger stresses in step wise fashion.

The second type is a standard "chinese finger" style cable grip (not shown) made of galvanized wire.

This third type is a compression fitting (also not shown), made by placing a section of 2½ inch I.D. steel pipe over the end of the rubber cord, and pressing or "crimping" it until it permanently deforms. This results in a section of reduced area through which the outer end of the cord cannot pass.

The ultimate design of the exemplary embodiment employed a termination of the first type employing a 6 inch length of 2½ inch schedule 40 black iron pipe with 5⅜ inch diameter bolts equally spaced. This particular termination enabled samples to be stressed up to 150% elongation before sheer failure at the first bolt hole, which could accommodate a tower displacement up to 45°. One tether has been replaced with a cord having a termination of the third type for field evaluation.

It will be appreciated that the use of elastomeric cord for the tethers 70 is exemplary only. There are a wide variety of suitable constructions and materials to choose from, including: (1) any elastomer of suitable length and section, such as rubber, polyurethane, nylon, or other synthetics, either in solid cord or individual strands, with or without wire, chain or rope in combination; or (2) a coil spring of a metallic alloy either with or without wire, chain or rope in combination; or (3) pneumatic springs which use the compression and expansion of a gas as a restoring force, either with or without wire, chain or rope in combination; or (4) any combination of the above.

As noted above, an important aspect of the invention is the ability to design or "tune" the structure for a desired response to a given environment. In general, there are three design-adjustable parameters: stiffness, mass, and dampening. Stiffness in turn has two components, the restoring force generated by the elastic tethers 70 and the restoring force generated by buoyancy of the column 20 itself. Mass of course is the mass of the various components, and can vary greatly depending upon the materials selected. Dampening is the resistance to movement as the tower in particular moves through the water, and is a function of its size and shape.

The characteristics of the elastic tethers 70 is an important element of the "tuning" during design. As noted above, the tethers provide a restoring force to displacements from equilibrium. The tethers 70 provide dynamic control for the tower 20 to achieve stability under wind and wave loading. Again, the tethers 70 do not "support" the tower 20 from falling over, as this function is provided by the buoyancy of the column 20. The amount of restoring force is tuned to provide the required combination of restoring force and allowable excursion before failure of the elastic tether. The construction and material selected to meet the prevailing conditions and requirements of the particular installation, and the amount of restoring force or "stiffness" may even be variable on one installation to match changing loads or conditions.

Considering buoyancy, the shapes, size and location of buoyant members can be tailored to a particular application. Moreover, where buoyancy is provided by buoyancy tanks affixed to the column 20, the buoyancy of the column 20 can be made to vary to meet changing weather conditions by employing pumps and compressors to pump air and water into and out of the buoyancy tanks.

It will be appreciated that it is a straightforward engineering calculation to determine how much the structure would deflect from vertical under a particular force. Dampening similarly can be calculated. Moreover, even after the structure is designed and installed, its characteristics can thereafter be changed, for example, by changing the springs. In addition, buoyancy of the column 20 can be altered.

To further elaborate, as noted above, the example described up to this point is for an instrumentation platform in open ocean fifteen miles offshore in water thirty feet deep, designed such that force of waves ten feet high should not cause deflection more than 10° from vertical. A resonant frequency corresponding to an oscillation period of one second ensures that resonant oscillations can be excited only by relatively small waves, unlikely to have sufficient energy to cause harm.

As another example, a structure may be designed as a mooring for a ship. A typical example would be a column one hundred feet tall for mooring a ship in water seventy to eighty feet deep. A typical design objective would be, at a given sea state, to allow no more than 20° deflection from vertical. It will be appreciated that a structure in accordance with the invention, embodying buoyancy, elasticity and articulation, can readily be designed employing straightforward engineering calculations to satisfy these objectives.

Figure 8:
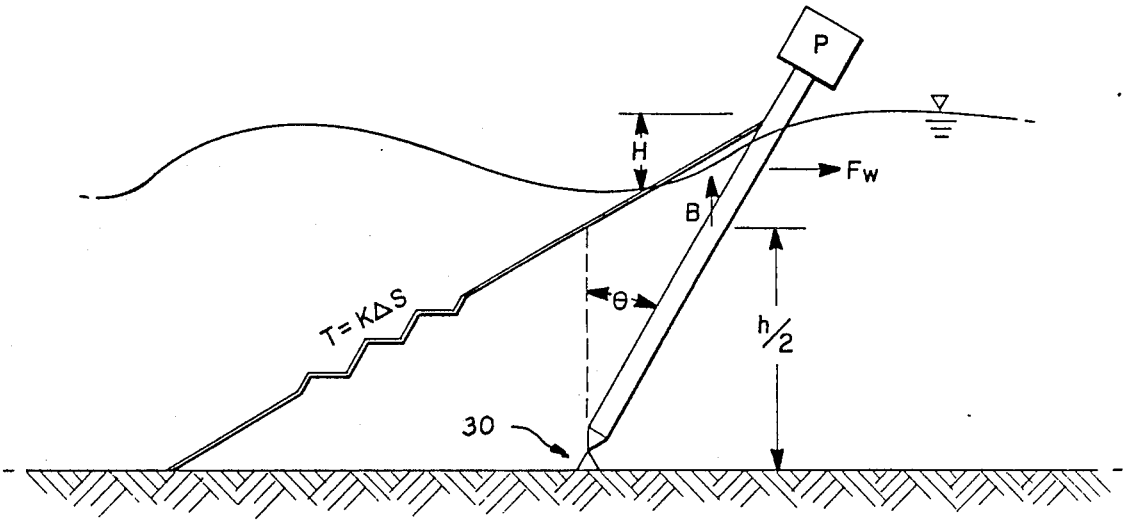
FIG. 8 is a schematic representation, for purposes of analysis, of the column of FIG. 7 showing the balance of forces acting on the structure under wave loading.

With reference now to FIGS. 7 and 8, the engineering design considerations will be described in greater detail.

A typical analysis begins by determining an equation of motions, Equation (3) below. With reference to FIG. 8, moments are summed about the articulated joint 30 at the column base as follows:

$$\Sigma M_B = W\frac{L}{2}\sin\theta - B\frac{h}{2}\sin\theta + PL\sin\theta - \int_0^h y^3\left(\tfrac{1}{2}\rho C_D D\frac{d\theta}{dt}\left|\frac{d\theta}{dt}\right|\right)dy - 2ky'\sin\theta\sin\beta y' + Fwh = I\frac{d^2\theta}{dt^2} \quad (1)$$

where:

W=Weight of column
L=Length of column
B=Buoyancy of column
P=Weight of payload
h=Water depth
$\rho$=Density of water
$C_D$=Drag coefficient
D=Column diameter
k=Spring constant
y'=Elevation of tether attachment
y=Distance along column axis, starting at base
$\beta$=Angle between tether and column
Fw=Wave force
I=Total mass moment of inertia of tower
$\theta$=Angular displacement of tower An assumption is made (later verified in the output results) that the displacement is small such that $\sin\theta \simeq \theta$. Then:

$$I/h\frac{d^2\theta}{dt^2} + \frac{h^3}{8}\rho C_D D\frac{d\theta}{dt}\left|\frac{d\theta}{dt}\right| + \frac{1}{h}\left(2Ky'^2\sin\beta - W\frac{L}{2} + Bh/2 - PL\right)\theta = Fw \quad (2)$$

Using Minorsky's linearization technique, Equation (2) can be written in its linearized form as:

$$\frac{I}{h}\frac{d^2\theta}{dt^2} + \frac{\alpha\Omega}{3\pi}(h^3\rho DC_D)\frac{d\theta}{dt} + \frac{1}{h}\left(2ky'^2\sin\beta - W\frac{L}{2} + Bh/2 - PL\right)\theta = Fw \quad (3)$$

where $$\Omega = \frac{\left(2ky^2\sin\beta - W\frac{L}{2} + B\frac{h}{2} - PL\right)}{I} \quad (4)$$

The above Equation (3) is then the equation of motions.

Hereinbelow, when the spectral density of the response to wave forces is derived, the transfer function implicit in Equation (3) will be useful.

The magnitude of the transfer function is;

$$|H(jw)|^2 = \frac{1}{(K - MW^2)^2 - (GW)^2} \quad (5)$$

where $$K = \frac{1}{h}\left(2ky^2\sin\beta - W\frac{L}{2} + B\frac{h}{2} - PL\right) \quad (6)$$

$$G = \frac{\alpha\Omega}{3\pi}(\rho DC_D h^3) \quad (7)$$

and $$M = I/h \quad (8)$$

The next step is to calculate I, the mass moment of inertia of the system about the articulated joint 30. This is the sum of the inertial terms of the column, the payload, and the added mass of water moving with the column.

$$I = \int y^2 dm + \frac{P}{g}L^2 + \int y^2 dm_a \quad (9)$$

for the column, $$dm = \mu dy \quad (10)$$

where $\mu$=mass per unit length of the column. So $$\int y^2 dm = \int y^2 \mu dy \quad (11)$$

$$= \mu\int_0^L y^2 dy \quad (12)$$

$$= \mu\frac{L}{3} \quad (13)$$

The added mass of the water is $$dm_a = \frac{\pi D^2}{4}\rho dy \quad (14)$$

so

-continued $$\int y^2 dm = \int y^2 \frac{\pi D^2}{4} \rho dy \quad (15)$$

$$= \frac{\pi D^2 \rho}{4} \int_0^L y^2 dy \quad (16)$$

$$= \frac{\pi D^2 \rho L^3}{12} \quad (17)$$

Thus $$I = \frac{\mu L^3}{3} + \frac{PL^2}{g} + \frac{\pi D^2 \rho L^3}{12} \quad (18)$$

Finally, expressing the buoyancy force, $$B = \frac{\pi D^2 h}{4} pg \quad (19)$$

all terms on the left side of the original equation of motions, Equation (3), have been defined.

The right side of Equation (3) requires that wave force, Fw, be analyzed. Writing the Morrison equation, $$Fw(t) = C_D |V(t)| V(t) + C_M A(t) \quad (20)$$

where $C_D$=Coefficient of drag $C_M$=Coefficient of inertia

V(t)=Horizontal water particle velocity

A(t)=Horizontal water particle acceleration

The Morrison equation, in the time domain above, can be changed to the frequency domain by use of covariance functions of V(t) and A(t), calculated from the spectral densities $S_{vv}(f)$ and $S_{aa}(f)$ via their Fourier transform, so $$S_{FF}(f,z) = \frac{C_D^2 V_{vv}^4}{\pi} \left( \frac{8 S_{vv}(f)}{V_w^2} + \ldots \right) + C_M^2 S_{aa}(f) \quad (21)$$

where $S_{FF}(f,z)$=Spectral density of wave force on the column at an elevation z, above seafloor $S_{vv}(f)$=Spectral density of horizontal water particle velocity at z $S_{aa}(f)$=Spectral density of horizontal water particle acceleration at z $V_{vv}^2$=Variance of $S_{vv}(f)$ The total force on the column is found by integrating Equation (21) with respect to depth.

$$S_{FF}(f) = \int_0^h S_{FF}(f,z) \quad (22)$$

Using linear wave theory $$S_{vv}(f) = \frac{(2\pi f)^2 \cosh^2(2\pi/\lambda_o)}{\sinh^2(2\pi h/\lambda_o)} S_{nn}(f) \quad (23)$$

$$S_{aa}(f) = \frac{(2\pi f)^2 \cosh^2(2\pi z/\lambda)}{\sinh^2(2\pi h/\lambda)} S_{nn}(f) \quad (24)$$

where

λ=is the wave length $S_{nn}(f)$ is the single sided spectrum of water surface z=specific height above the seabed f=frequency The variance of the velocity $V_{vv}^2$, also at a particular height above the sea bed, is found by integrating the velocity spectrum. It may be noted that the mean value of the velocity is zero.

$$V_{vv}^2 = \int_0^\infty \frac{(2\pi f)^2 \cosh^2(2\pi z)/\lambda}{\sinh^2(2\pi h/\lambda)} S_{nn}(f) df \quad (25)$$

Using the approximation that $\lambda \simeq \lambda_o$=deepwater wave length, then $$\lambda_o = gT^2/2\pi = \frac{g}{2\pi f^2} \quad (26)$$

can be substituted in subsequent expressions.

Equation (22) can now be expressed $$S_{FF}(f) = \int_0^h \frac{8 C_D^2 V_{vv}^2}{\pi} (2\pi f)^2 \left\{ \frac{\cosh^2[(2\pi f)^2 z/g]}{\sinh^2[(2\pi f)^2 h/g]} \right\} S_{nn}(f) dz + \int_0^h C_M^2 (2\pi f)^4 \left\{ \frac{\cosh^2[(2\pi f)^2 z/g]}{\sinh^2[(2\pi f)^2 h/g]} \right\} S_{nn}(f) dz \quad (27)$$

Finally, the spectral density of the response, $S_{\theta\theta}(f)$ is found from Equation (27) and the transfer function of Equation (5)

$$S_{\theta\theta}(f) = |H(jf)|^2 \cdot S_{FF}(f) \quad (28)$$

From the spectral density of the response, other parameters can be specified, such as the mean excursion, $\bar{\theta}$ and the maximum excursion, $\theta_m$. The natural frequency of the model is calculated from Equations (6) and (8) since $$N = \frac{\sqrt{K}}{M} \quad (29)$$

The foregoing equations were solved with the aid of a computer and employing numerical integration techniques. The input information contained the hydrodynamic and structural parameters. The hydrodynamic parameters are ρ, mass density of water, h, the still water depth, $C_D$, the drag coefficient and $C_M$, the inertial coefficient.

ρ was assumed constant at 2 slugs/ft.$^3$ h was assumed constant at 30 ft.

$C_D$ and $C_M$ were taken from tables after first calculating the Reynolds Number for the flow past the column.

A significant one of the parameters solved for is the magnitude of the oscillatory angular displacement, θ, for various combinations of the input parameters.

In the computer program employed for solution of the equations, an interation process is used, comparing successive estimates. The initial value used is θ=10°=0.18 radians. Some structural parameters were also assumed constant. These included the length of the column, L=40 ft. The diameter of the column, D=1 ft. The total weight of the column, W=685 lb. The mass per unit length of the column, μ=0.5 slugs/ft.

The remaining four structural parameters were independently varied and the output response was compared in order to effect the optimum configuration. Significantly, these variables are easiest to modify, even after the structure is predominantly complete. These are specifically:

k=The spring constant of the elastic portion of the tethers, y'=The elevation of the tether attachment point on the column, relative to the sea floor, P=The payload at the top of the tower, including platform, instruments, batteries and solar panels, and $\beta$=The vertical angle the tether makes with the side of the column.

In the table below, the weight, P, of the payload is constant at 190 lbs, and thus not shown.

The three outputs are shown, namely, $\bar{\theta}$=Average excursion of the column, degrees $\theta_m$=Minimum excursion of the column, degrees $\Omega$=Natural frequency (1st mode) of the structure, in Hz.

TABLE

FREQUENCY RESPONSE OF STRUCTURE TO WAVE LOADING

| Case | y' | $\beta$ | k | $\theta$ | $\theta_m$ | $\Omega$ |
|---|---|---|---|---|---|---|
| 1 | 34 | 60 | 75 | 0.7 | 2.6 | 0.3 |
| 2 | 34 | 60 | 130 | 0.3 | 1.3 | 0.4 |
| 3 | 34 | 60 | 190 | 0.2 | 0.9 | 0.5 |
| 4 | 34 | 60 | 240 | 0.2 | 0.7 | 0.5 |
| 5 | 34 | 60 | 300 | 0.1 | 0.5 | 0.6 |
| 6 | 36 | 60 | 130 | 0.3 | 1.2 | 0.4 |
| 7 | 36 | 80 | 130 | 0.2 | 0.9 | 0.4 |
| 8 | 36 | 60 | 190 | 0.2 | 0.8 | 0.5 |
| 9 | 36 | 80 | 190 | 0.2 | 0.6 | 0.5 |
| 10 | 38 | 60 | 130 | 0.3 | 1.1 | 0.4 |
| 11 | 38 | 80 | 130 | 0.2 | 0.8 | 0.4 |
| 12 | 38 | 60 | 190 | 0.2 | 0.7 | 0.5 |
| 13 | 38 | 80 | 190 | 0.1 | 0.5 | 0.5 |
| 14 | 40 | 60 | 130 | 0.3 | 1.0 | 0.4 |
| 15 | 40 | 80 | 130 | 0.2 | 0.7 | 0.4 |
| 16 | 40 | 60 | 190 | 0.2 | 0.6 | 0.5 |
| 17 | 40 | 80 | 190 | 0.1 | 0.5 | 0.5 |

From the above table, it will be seen that the maximum predicted excursion, $\theta_m$, is well below the required 10° for all cases examined. This allows a configuration to be chosen that not only minimizes oscillation amplitude, but places the natural frequency of the structure above the dropoff frequency for the forcing function, that is 0.25 Hz.

The dominant parameter is the spring stiffness, k, having a marked effect on reducing displacement up to a value of approximately 200 lb f/ft and a lesser effect at higher values.

The angle, $\beta$, while effective in reducing displacement, is limited by practical considerations on the horizontal spread of the moorings. This is also related to the elevation, y', of the tethers. The final selection of the position resulted from the structural and fabrication considerations. The pad eyes for attachment of the tethers were placed below the platform flange where they doubled as gussets. Restricting the mooring radius to 100 ft maximum results in a tether angle of about 70°.

Figures 9A, 9B:
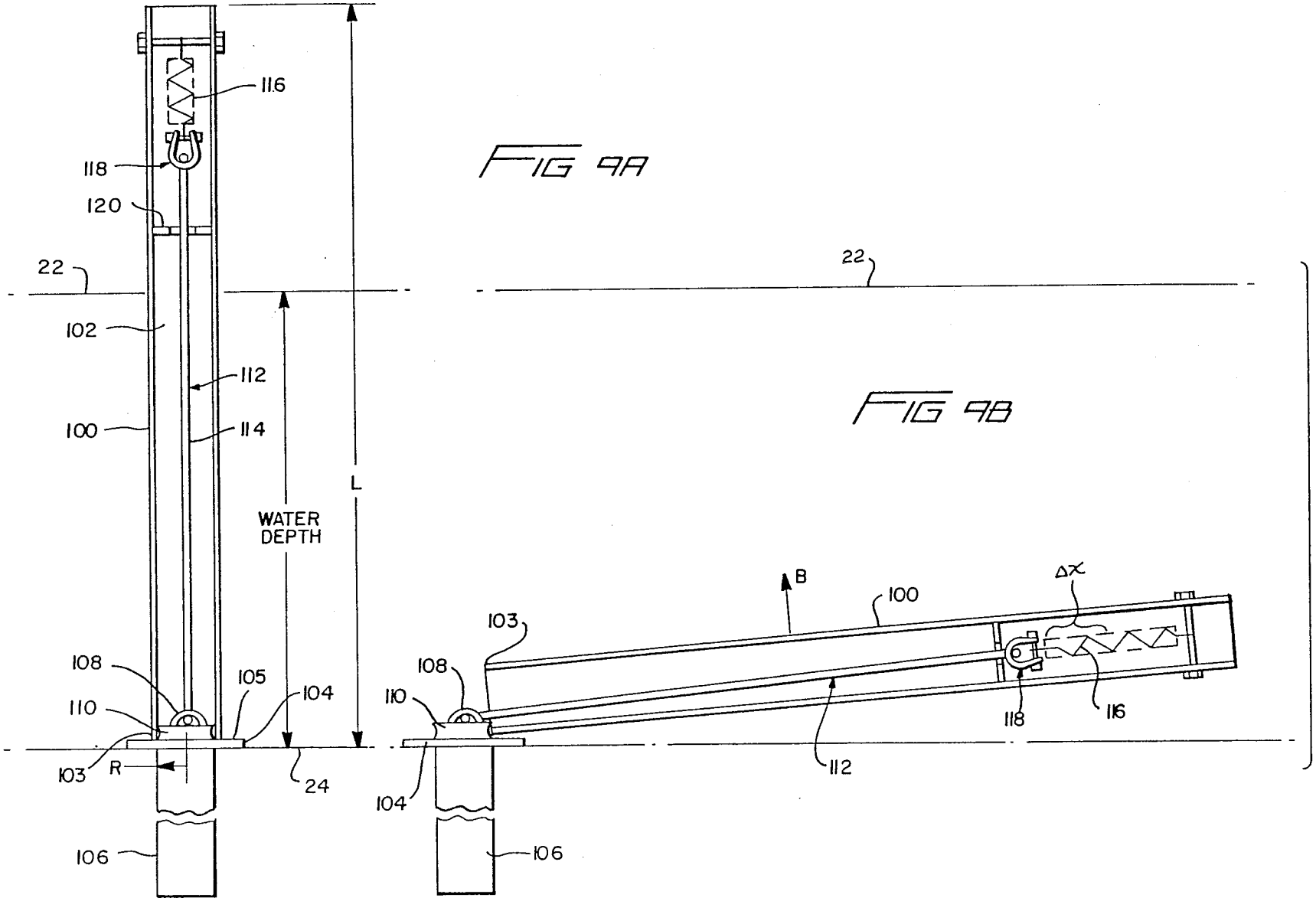
FIGS. 9A and 9B are schematic depictions showing upright and full deflection positions, respectively, of an embodiment of the invention employing a parallel-extending internal tensile elastic element of compact form.

Referring now to FIGS. 9A and 9B, shown is the first of several embodiments of the invention which may be described as compact types, which enable vessels to safely pass close by the column.

In FIGS. 9A and 9B, a buoyant column 100 takes the form of a tubular element having an interior space 102 and a base end 103. A defined central axis extends within the interior space. A plate-like base mooring element 104 includes a surface 105 and is fixed to an anchor piling 106 of sufficient section and length to provide the required anchoring force. The base mooring element 104 also includes a base attachment point 108 substantially in alignment with the central axis of the column 100 when the column 100 is in the equilibrium position as shown in FIG. 9A.

To provide an articulated joint, a suitably configured element 110 projects upwardly from the base mooring element 104 to engage the base end 103 of the buoyant column 100. Thus, as the column 100 tilts from vertical, even all the way to the near horizontal position depicted in FIG. 9B, and returns to vertical, the column 100 remains properly located. It will be appreciated that the particular configuration of the upwardly-projecting element 110 is exemplary only, and that various forms may be employed.

To complete the structure, an elastic element, generally designated 112 is provided, and comprises a rigid extension rod 114 and a tension spring 116 connected by a dismantlable upper joint 118. The elastic element 112 extends along the central axes between an upper attachment point 120 spaced from the column base end, and the base attachment point 108. Finally, an apertured retention plate 120 is provided near the upper end. With this particular configuration, the tension spring 116 is accessible and repairable from the surface.

In view of the substantial compression load on the column 100 as a result of the tension elastic element, the section modulus of the column 100 should be sufficient to withstand the impact of a collision, and not be induced to buckle thereby.

During operation, it will be appreciated that, at the column equilibrium position depicted in FIG. 9A, the elastic element 112 is at its minimum length and the base 103 of the column 100 rests squarely on the surface 105 of the base mooring element 104. Pivotal movement of the column 100 raises portions of the column base 103 off of the supporting surface 105, except for a contact area facing the direction of the tilt. Thus, the elastic element 112 is extended, and the restoring force which it accordingly generates provides a force urging the column 100 back towards the equilibrium position of FIG. 9A.

As represented in FIGS. 9A and 9B, the tension spring 106 has a spring constant k and an elastic elongation $\Delta_x$, the column 100 radius is R, and the height of the column 100 is L. In FIG. 9B, the buoyant force is represented as B.

Thus, with this particular geometry, the total restoring moment may be expressed as $$\text{Restoring Moment} \simeq k\Delta_x R + \frac{BL}{2} \tag{30}$$

Figures 10A, 10B:
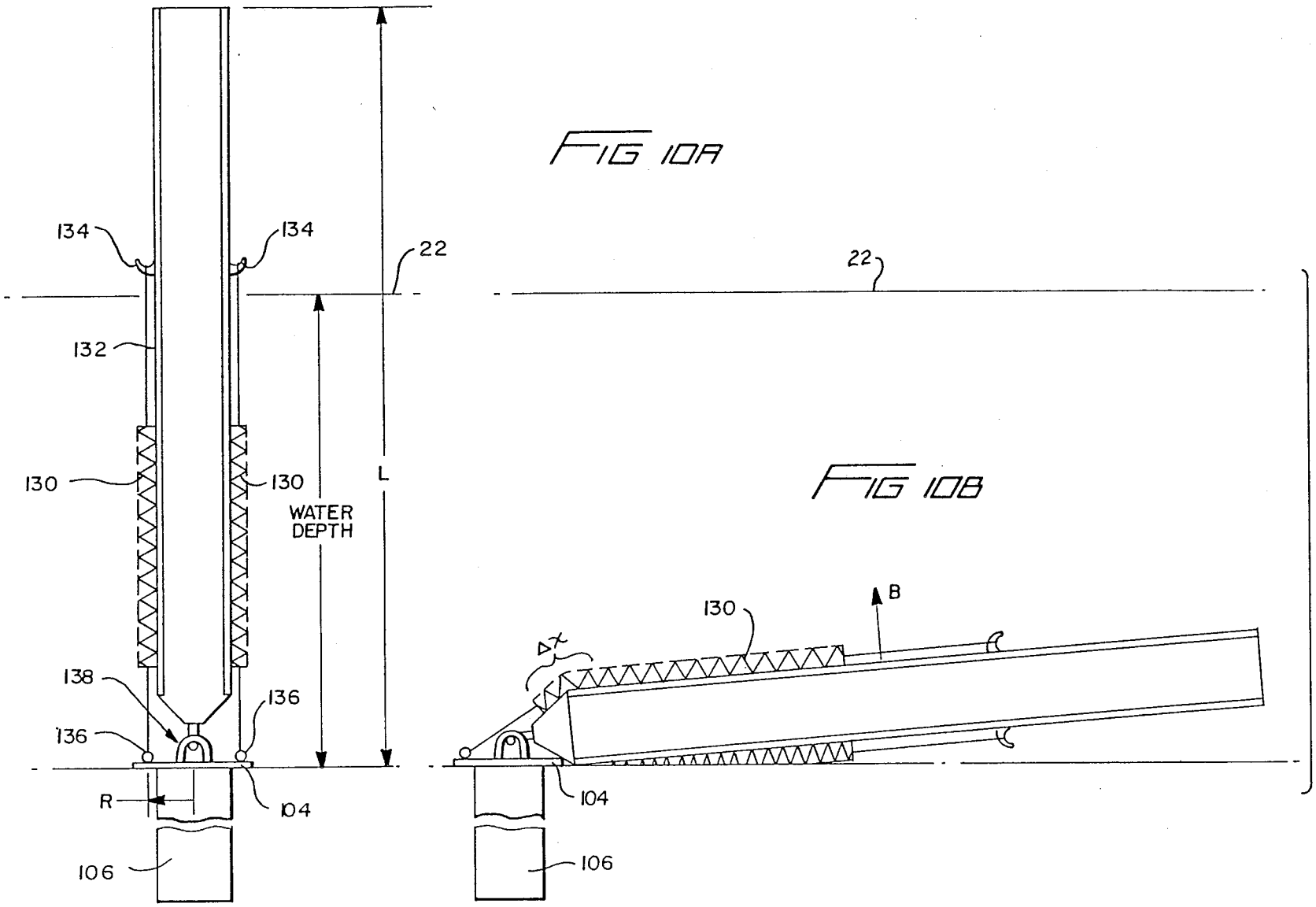
FIGS. 10A and 10B are schematic depictions showing upright and full deflection positions, respectively, of an embodiment of the invention employing parallel-extending external tensile elastic elements of compact form.

FIGS. 10A and 10B similarly depict an embodiment employing exterior tensile elastic members 130 which extend generally parallel to a buoyant column 132 between upper 134 and lower 136 attachment points. The lower attachment points 136 are fixed to the base mooring element 104 adjacent an articulated joint 138 shown as a pair of chain links as in FIG. 3.

It will be appreciated that the embodiment of FIGS. 10A and 10B is geometrically quite related to the form of FIGS. 2, 7 and 8, except that the moment arm on which the spring operates to provide a restoring force is greatly decreased. In order to achieve the same restoring force, the decreased moment arm requires a spring approximately (L/R) times as stiff, where L is the length of the column and R is its ratio, and L/R may thus be termed an aspect ratio. This aspect ratio could approach 50 or 60 for deeper water. It is estimated that a spring having a constant of 10,000 pounds per foot of elongation would be sufficient.

Figures 11A, 11B:
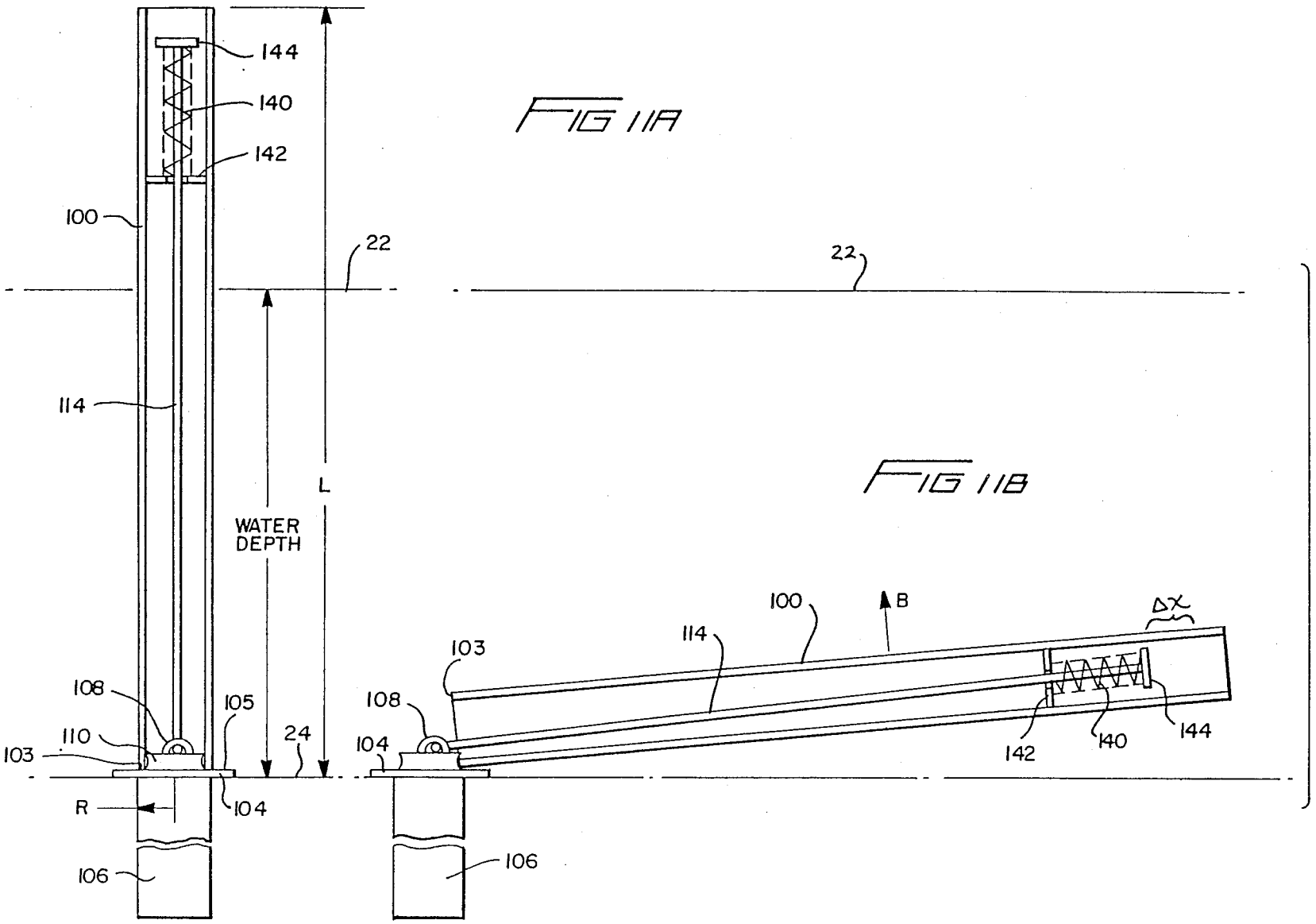
FIGS. 11A and 11B are schematic depictions showing upright and full deflection positions, respectively, of an embodiment of the invention employing a parallel-extending internal compression elastic element of compact form.

The embodiment of FIGS. 11A and 11B is like that of FIG. 9A, except that the elastic element includes a compression spring 140 compressed between a removable compression plate 142 and an appropriate fitting 144 at the end of a rigid tension rod 146.

Figures 12A, 12B:
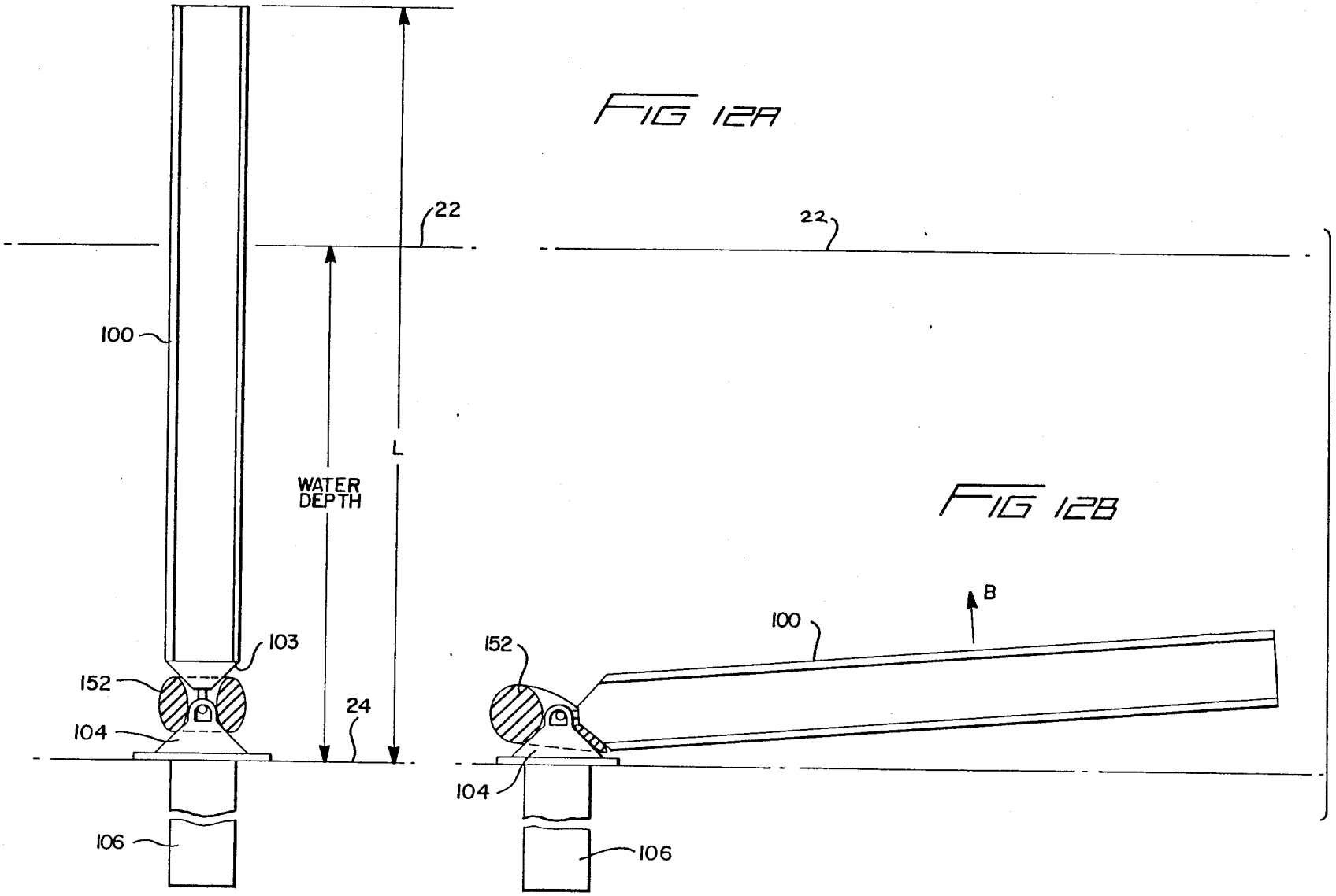
FIGS. 12A and 12B are schematic depictions showing upright and full deflection positions, respectively, of an embodiment of the invention employing an external torodial compression elastic member of compact form at the column base.

Finally, FIGS. 12A and 12B depict an embodiment wherein a suitably configured annular gap 150 is defined between the column base end 103 and the base mooring element 104. A torodial compressive element 152 is disposed in the annular gap 150, and the element 152 provides restoring force when the column is deflected as in FIG. 12B.

While a variety of embodiments have been presented hereinabove, an analysis of the four embodiments of FIGS. 9A–12B will provide a useful illustration of design considerations and compromises. The various designs may be classified into two classes, low risk and high risk. The risk refers to the probability of failure of the elastic member. The other components of the four designs are classed as low risk.

Class 1, High Risk: embodiments of this class employ tensile springs. Tensile springs will most likely exhibit larger rang of elastic deformation and higher restoring forces per unit area.

Class 2, Low Risk: Simply stated, while it is possible to tear an elastic body apart, it is improbable that it could be compressed to failure by forces of the magnitude expected. Embodiments of this class employ compression spring members.

In each class two types are presented, "A" and "B". Type "A" has the capability of having its elastic members replaced upon failure, in situ through the use of hand tools alone. It is expected that this type will be somewhat more costly to fabricate.

Type "B" is of simpler construction, but failure of the elastic members will likely require the use of divers for in situ replacement. Alternately, the structure could be removed intact and replaced by use of a derrick vessel.

The four embodiments of FIGS. 9A–12B are now briefly analyzed in light of the classes and types defined immediately above:

Class 1, Type "A". FIGS. 9A and 9B

Special Features: Internal tensile elastic members accessible from surface; double joint connected by extension rod; break-apart top joint to allow spring replacement; buoyant compliant body held captive by retention plate following spring failure; nested cylinders tilting base; capable of zero deflection up to threshold loading.

Class 1, Type "B". FIGS. 10A and 10B

Special Features: Exterior tensile elastic members; single articulating connecting joint; buoyant compliant body held captive by joint following spring failure.

Class 2, Type "A". FIGS. 11A and 11B

Special Features: Internal compression elastic member accessible from surface. Single joint with extension rod to compression plate; removable compression plate to allow spring replacement; buoyant compliant body held captive by compression plate following springs failure; nested cylinder tilting base; capable of zero deflection up to threshold loading.

Class 2, Type "B". FIGS. 12A and 12B

Special Features: External toroidal compression elastic member at base; single articulating connecting joint; buoyant compliant body held captive by joint following spring failure.

Moreover, each of the embodiments of FIGS. 9A–12B has the advantage of installability and removability in a manner substantially indentical to present practice with respect to ordinary pilings. In particular, each of the embodiments can be entirely assembled prior to installation, including assembly of the column to the base mooring element 104 and thus to the anchor piling 106, and assembly of the elastic elements. While it is entirely feasible to make the buoyant column sufficiently strong to withstand pile driving, it may be desirable with respect to cost, or response considerations, or both, to use lightweight, or inexpensive, or both, materials for the column not suitable for pile driving. In such cases, a simple driving "sleeve" (not shown) can be dropped over the column to make contact with the surface 105 of the base mooring element 104 below the articulated joint. The sleeve is then withdrawn vertically after installation. Any platform supported at the top of the column would be installed later.

The tensile strength of the structure is preferably sufficient to enable removal of the anchor piling 106 by attachment to an appropriate portion of the structure above the waterline.

In view of the foregoing, it will be appreciated that the invention effectively provides a stable platform above or in the water that is capable of surviving extreme environmental conditions and of minimizing risk and damage to itself and a vessel in the event of a collision. Uses include, but are not limited to, navigational aids, data collection, energy extraction, aquaculture, and drilling platform. In addition, there are other loads the structure could effectively support besides a platform, particularly if use multiply as supports for a larger structure, such as nets, groins, breakwaters, seawalls or weirs. In such an application, several BETA towers would be spaced at intervals, with a netting, fabric or panels of appropriate dimension and permeability suspended between to stop or divert the flow of waves, currents, or elements in the water.

Considering in particular application as a navigations aid, the current practice of maintaining navigational aids involves the use of slack-moored, surface following buoys, or rigid vertical piles. The advantages of a BETA platform in accordance with the invention over both include:

(1) Survivability;

(2) Positional accuracy; (buoys swing on their moorings and are only approximately where they are plotted)

(3) Visibility; (due to its stability, a light or day shape would be much easier to see)

(4) Safety; and (obviously, collision with a vertical compliant cylinder should be much less damaging to the structure and the vessel than either a rigid piling or a large floating buoy. Even in comparison to small, "soft" i.e., foam or inflatable—buoys, there is no danger of fouling the vessel's wheel in the mooring)

(5) Cost; (procurement cost is comparable to buoys, somewhat more than rigid pilings. Installation cost is less than for pilings, since no pile driver is required, and comparable to or somewhat greater than slack moored buoys. Maintenance cost is expected to be less than for slack buoys, particularly offshore where frequent replacement and/or repositioning is required after storms, and comparable or somewhat greater than rigid pilings).

Considering in particular application for data collection, a prototype as described hereinabove was designed for this purpose, and preliminary indications are that it is performing well.

Considering in particular application for energy extraction the BETA platform is attractive for this application for the same reasons of economy, stability and survivability. For extraction of wave energy in particular, the design offers a choice of two approaches.

(1) As a stable, stiff platform that extracts energy from the flow of water relative to the structure i.e., through turbines.

(2) As a highly compliant, flow following structure that extracts energy through the relative motion of the structure and its base—i.e., a system of pulleys and wheels driven by the tethers.

Finally, considering in particular application as a drilling platform, it is believed that the design of a BETA platform in accordance with the invention can be scaled up for deeper waters of one thousand feet, or more.

While specific embodiments of the invention have been illustrated and described herein, it is realized that numerous modifications and changes will occur to those skilled in the art. It is therefore to be understood that the appended claims are intended to cover all such modifications and changes which fall within the true spirit and scope of the invention.

What is claimed is:

1. A marine structure for supporting a load, said marine structure being positioned in a body of water having a floor, and comprising:

a base mooring element fixed to the floor;

a positively buoyant column having a base end and an opposite end;

at least one articulated joint between said column base end and said base mooring element permitting pivotal movement of said column; and at least one elastic element connected to said column for urging said column towards an equilibrium position and for providing a restoring force following displacements of said column from the equilibrium position, wherein said elastic element is vertical when the column is in its equilibrium position.

2. A marine structure in accordance with claim 1 wherein said column has an outside wall and wherein said elastic element extends along just outside said outside wall and generally parallel to said column.

3. A marine structure in accordance with claim 1 wherein said column is hollow along at least part of its length and said elastic element extends along said at least part of said length.

4. A marine structure for supporting a load, said marine structure being positioned in a body of water having a floor, and comprising:

a base mooring element fixed to the floor;

a positively buoyant column having a base end and an opposite end;

at least one articulated joint between said column base end and said base mooring element permitting pivotal movement of said column; and at least one elastic element connected to said column for urging said column towards an equilibrium position and for providing a restoring force following displacements of said column from the equilibrium position, wherein said elastic element extends within an interior space of said column.

5. A marine structure in accordance with claim 4, wherein said elastic element comprises at least one elastic section in combination with at least one relatively inelastic section.

6. A marine structure in accordance with claim 5, wherein said elastic section is disposed within said column adjacent said end opposite said base end.

7. A marine structure in accordance with claim 6, wherein said elastic section is a coil spring which is accessible from the surface of the body of water.

8. A marine structure in accordance with claim 4, wherein said elastic element is secured to a base attachment point in line with said column.

9. A marine structure in accordance with claim 4 wherein said column is hollow along at least part of its length and said elastic element extends along said at least part of said length.

10. A marine structure for supporting a load, said marine structure being positioned in a body of water having a floor, and comprising:

a base mooring element fixed to the floor;

a positively buoyant column having a base end and an opposite end;

at least one articulated joint between said column base end and said base mooring element permitting pivotal movement of said column; and at least one elastic element connected to said column for urging said column towards an equilibrium position and for providing a restoring force following displacements of said column from the equilibrium position;

said buoyant column comprises a tubular element having an interior space and having a defined central axis extending within said interior space; wherein said base mooring element includes a surface for supporting the base end of said buoyant column, and a base attachment point substantially in alignment with the central axis of said column when said column is in its equilibrium position; wherein said articulated joint includes an element projecting upwardly from said base mooring element to engage the base end of said buoyant column; and wherein said elastic element extends within the interior space of said column between a portion of said column spaced from said base end and said base attachment point.

11. A marine structure in accordance with claim 10, wherein said articulated joint and said elastic element are constructed so as to accommodate a 90° pivotal displacement of said column and subsequent restoration without damage.

12. A marine structure in accordance with claim 10, wherein said elastic element comprises an elastomeric material.

13. A marine structure in accordance with claim 10, wherein said elastic element comprises a coil spring.

14. A marine structure in accordance with claim 13, wherein said elastic element comprises at least one coil spring in combination with a relatively inelastic section.

15. A marine structure in accordance with claim 10, wherein said articulated joint includes elements fixing said column base end to said base mooring element in a manner which permits pivotal movement while restraining translational movement.

* * * * *